US006027063A

United States Patent [19]

Jaschke

[11] Patent Number: 6,027,063

[45] Date of Patent: Feb. 22, 2000

[54] TAKEUP MACHINE WITH THREADUP DEVICE

[75] Inventor: Klemens Jaschke, Huckeswagen, Germany

[73] Assignee: Barmag AG, Remscheid, Germany

[21] Appl. No.: 09/125,577

[22] PCT Filed: Nov. 25, 1997

[86] PCT No.: PCT/EP97/06562

§ 371 Date: Aug. 20, 1998

§ 102(e) Date: Aug. 20, 1998

[87] PCT Pub. No.: WO98/28217

PCT Pub. Date: Jul. 2, 1998

[30] Foreign Application Priority Data

Dec. 20, 1996 [DE] Germany ..... 196 53 544

[51] Int. Cl.[7] ..... B65H 18/08

[52] U.S. Cl. ..... 242/476.1; 242/473.8; 242/481

[58] Field of Search ..... 242/476.1, 474.5, 242/474.8, 473.8, 481

[56] References Cited

U.S. PATENT DOCUMENTS

| | | | |
|---|---|---|---|
| 4,057,195 | 11/1977 | Jones et al. | 242/476.1 |
| 4,136,834 | 1/1979 | Tschentscher | 242/476.1 |
| 4,456,187 | 6/1984 | Bloomfield et al. | 242/476.1 |
| 4,465,242 | 8/1984 | Ari et al. | 242/476.1 |
| 4,477,032 | 10/1984 | Pfyffer et al. | 242/476.1 |
| 4,784,342 | 11/1988 | Matthies et al. | 242/476.1 |
| 5,016,829 | 5/1991 | Schippers et al. | 242/473.8 X |
| 5,526,995 | 6/1996 | Westrich et al. | 242/474.5 |
| 5,716,016 | 2/1998 | Iwade et al. | 242/474.5 |
| 5,779,170 | 7/1998 | Siepmann et al. | 242/474.5 X |

FOREIGN PATENT DOCUMENTS

| | | |
|---|---|---|
| 2 354 954 | 1/1978 | France . |
| 26 27 643 | 12/1977 | Germany . |
| 31 36 908 | 5/1982 | Germany . |
| 631 677 | 8/1982 | Switzerland . |

OTHER PUBLICATIONS

Patent Abstracts of Japan, vol. 015, No. 414, Oct. 22, 1991 & JP 03 172285, Jul. 25, 1991.

Patent Abstracts of Japan, vol. 097, No. 004, Apr. 30, 1997 & JP 08 319061, Dec. 3, 1996.

*Primary Examiner*—Donald P. Walsh
*Assistant Examiner*—Minh-Chau Pham
*Attorney, Agent, or Firm*—Alston & Bird LLP

[57] ABSTRACT

A yarn winding machine for winding a plurality of yarns on a corresponding number of winding tubes. Each winding tube is associated with a contact yarn guide in a contacting position for threading the yarn. By means of a threadup device which includes, a threadup yarn guide moving along a guideway and stationary contact yarn guides, the yarns are distributed from a threading position to the contacting position. Between the threading position and the contacting position, the yarns are guided by the threadup yarn guide and distributed, one after the other, to the contact yarn guides.

16 Claims, 6 Drawing Sheets

TAKEUP MACHINE WITH THREADUP DEVICE

BACKGROUND OF THE INVENTION

The invention relates to a takeup machine for winding a plurality of yarns on a corresponding number of winding tubes of the type described in DE 31 36 908 A1.

In high-speed takeup machines, in particular for winding synthetic filament yarns, economic considerations have made it necessary to wind on a winding spindle a plurality of yarns, one after the other and independently of one another. From stationary yarn guides, the yarns advance each by means of a known traversing mechanism to their respective winding tube, which is mounted on the winding spindle. In this process, the leading yarn end is brought into contact with the winding spindle or winding tube by means of a yarn catching device. Such a yarn catching device is used to catch the yarn and, if need be, wind same on the starting end of the tube after forming a waste wind or a yarn reserve wind. Known are long winding spindles, which permit winding of up to eight packages at the same time. This requires an arrangement of yarn guides in spaced relationship along the winding spindle, with the spacing being greater than the actual package width. The longer the winding spindles, the more difficult it is for the operating personnel to thread the yarns on the individual winding tubes of such takeup machines. Primarily, a fast and reliable threading of the yarns is required even at very high yarn speeds.

It is also known to make for a larger number of yarns and an associated number of winding tubes the threading technique substantially independent of the skill of individual operators. In the case of this threading technique, contact yarn guides mounted on a rotatable arm extending parallel to the winding spindle, are arranged for movement along the winding spindle, and can be brought on the one hand to a threading position and on the other hand to a yarn contacting position. In the threading position, all contact yarn guides are arranged closely adjacent to one another on a part extending beyond the end of the winding spindle, so as to permit suction of a certain number of yarns with a yarn suction device, which is typically a yarn suction gun, and distribution of same in a simple manner to the contact yarn guides. In the yarn contacting position, the contact yarn guides are associated to the yarn catching devices, so that the yarns come into contact with same and can be grasped.

DE 31 36 908 A1 describes a device for the contact yarn guides, wherein each contact yarn guide is supported on a sliding element. The individual sliding elements are interconnected by a cable line mechanism, which permits moving same from the threading position to the yarn contacting position. This mechanism is relatively complicated and, thus, susceptible to breakdown. Because of the generally present extensibility of the cable in the cable line mechanism, same exhibits a conditional, limited stopping accuracy of the yarn guides that are supported by the sliding elements on the cable line mechanism.

Furthermore, DE-OS 26 27 643 and corresponding U.S. Pat. No. 4,136,834 disclose a yarn threadup device, wherein the respective contact yarn guides are attached to elements of the perforated disk type, which elements are interconnected by threaded rods. A rotation of the threaded rods permits variation of the spacings relative to one another between the elements accommodating the contact yarn guides from the yarn contacting position to the yarn threading position. This screw motion is on the one hand quite expensive, and requires a great deal of time. On the other hand, the entire mechanism must be enclosed, since it requires a corresponding lubrication for the threaded rods. Furthermore, this mechanism limits the number of yarn guides, which can be arranged respectively one after the other and side by side, as a result of limiting in the perforated disk type elements the number of tapholes that are to be accommodated for the connecting rods.

It is therefore the object of the invention to provide a takeup machine for winding a plurality of yarns to a corresponding number of packages, by which a constructionally simple threadup device is created that facilitates faster and simpler threading of the yarn by the operating personnel at high takeup speeds.

SUMMARY OF THE INVENTION

The above and other objects and advantages of the present invention are provided by a winding apparatus which comprises a winding spindle of a length sufficient to coaxially receive a plurality of winding tubes thereon, with the spindle defining an axis and a free end. A threadup device is provided for distributing the advancing yarns into contact with respective ones of the winding tubes so as to permit the threadup of the yarns onto the winding tubes. The threadup device comprises a stationary contact yarn guide positioned adjacent each of the winding tubes, with the contact yarn guides being aligned along a direction generally parallel to the axis of the winding spindle. Also, the threadup device further includes a threadup yarn guide configured to engage each of the advancing yarns and which is mounted for movement along a path of travel which is generally parallel to the axis of the winding spindle and which extends from a threading position located adjacent the free end of the winding spindle and along the contact yarn guides. Also, the threadup yarn guide and the contact yarn guides are configured to distribute the advancing yarns from the threadup yarn guide to respective contact yarn guides as the threadup yarn guide moves from the threading position along the path of travel.

An important advantage of this embodiment in accordance with the invention consists in that the layout of the threadup device in accordance with the invention is constructionally very simple and, moreover, facilitates exact positioning of the yarns in the contacting positions by the stationary contact yarn guides. Furthermore, threading of the yarns guided by means of a suction gun into the threadup yarn guide can be realized by the operating personnel in a single manual operation. Thereafter, the yarns are automatically distributed to the contact yarn guides in the contacting position without engagement by the operating personnel.

In a preferred embodiment of the invention, the threadup yarn guide is realized with a plurality of successively arranged yarn carriers, which are arranged relative to one another in terraced form ascending in the direction from the threading position toward the contact yarn guides. This enables a transfer of the yarns from the threadup yarn guide to the individual contact yarn guides without additional transfer devices.

In a further preferred embodiment, the yarn carriers are formed by guide grooves arranged along the direction of movement of the threadup yarn guide. As a result, the yarns are held in the threading position by a simple deflection about the threadup yarn guide. The contact yarn guides are arranged accordingly, one after the other in terraced manner, so that when moving the threadup yarn guide along the contact yarn guides, the yarns are reliably transferred from the yarn carriers to the contact yarn guides. To this end, the yarns are guided out of the guide grooves against the direction of movement of the threadup yarn guide. This arrangement is especially advantageous, when the threading position is arranged outside of the path of the individual yarns.

In a very advantageous embodiment of the takeup machine, the yarn carriers are formed by guide grooves arranged transversely to the direction of movement of the threadup yarn guide. In this arrangement, the yarns are guided, one after the other, during the movement of the threadup yarn guide along a strip with a guide edge ascending in direction of the contacting position, by the guide edge out of the guide grooves transversely to the direction of movement of the threadup yarn guide. This forced guidance of the yarns facilitates safe transfer to the contact yarn guides.

In this connection, it will be especially advantageous, when the contact yarn guides are formed by grooves in the strip, the grooves dividing the guide edge into several sections. This embodiment distinguishes itself in particular by a compact construction as well as a high reliability in operation.

In a further variant of the invention, the contact yarn guides are formed by individual, bent wire pieces. The wire pieces are mounted to the strip. Each wire piece is bent such that the wire piece forms a catching notch and a partial length of the guide edge. This permits realization of a threadup device that is light by its weight and simple.

Preferably, the threadup yarn guide is attached to a sliding element, which is guided in a guideway mechanically, pneumatically, or electrically. The guideway is made preferably straight-line. However, it may also be curved or have a different shape as is required for distributing the yarns.

In a very advantageous further development of the invention, the guideway is constructed as a tube, which has in its interior at least one magnetic element arranged for sliding movement, and on its outside a magnetic guide element with opposite magnetic polarity, which is arranged likewise for sliding movement. The movement of the magnetic piston inside the tube permits displacement without an additional displacement mechanism, as is present in yarn threadup devices of the prior art. In this arrangement, the magnetic piston is displaced in the interior of the tube preferably pneumatically.

In a further advantageous embodiment of the takeup machine, the threadup device is arranged such that for purposes of causing the yarns to contact the winding tubes, the yarns traverse the machine frame of the takeup machine substantially diagonally, note FIG. 2. With this arrangement the yarn can be caught on the winding tube both by the principle of common rotation, i.e., the yarn and the winding tube move in the same direction, and by the principle of counterrotation, i.e., the yarn and the winding tube move in opposite directions.

When bringing the yarns into contact with the winding tubes, the yarns are caught and cut on the winding tubes by means of catching devices. To this end, the yarns must assume a certain looping on the winding tube. To influence the yarn looping on the winding tubes, as well as to shorten the unguided yarn length between the winding tube and the contact yarn guide, it will therefore be of advantage, when the threadup device is arranged on a movable support, which can be moved to an operating position that is advantageous for threading. The mobility of the threadup device also permits distribution of the yarns to the winding positions in different positions on the takeup machine.

The takeup machine of the present invention is used primarily in spin lines for winding freshly spun synthetic filaments to packages. In this operation, the yarns exit from the spin line and advance, via a stationary yarn guide to each winding position of the takeup machine. To this end, it is necessary to spread the yarns in accordance with the spacing of the winding positions. To solve the problem of distributing the yarns to the stationary yarn guides, a very advantageous variant of the takeup machine in accordance with the invention is provided with a further threadup device. This second threadup device thus takes over the distribution of the yarns to the stationary yarn guides. To this end, the yarns are guided by means of a suction device and inserted in a threadup yarn guide of the second threadup device. Subsequently, the threadup yarn guide of the threadup device moves along a guideway and guides the yarns to the corresponding stationary yarn guides.

The second threadup device may constructed identically with the first threadup device. However, in the place of stationary contact yarn guides, it is also possible to use in the second threadup device stationary yarn guides of the machine.

BRIEF DESCRIPTION OF THE DRAWINGS

Some of the objects and advantages of the present invention having been stated, others will appear as the description proceeds, when considered in conjunction with the accompanying drawings, in which.

DETAILED DESCRIPTION OF THE PREFERRED EMBODIMENTS

Figure 1:
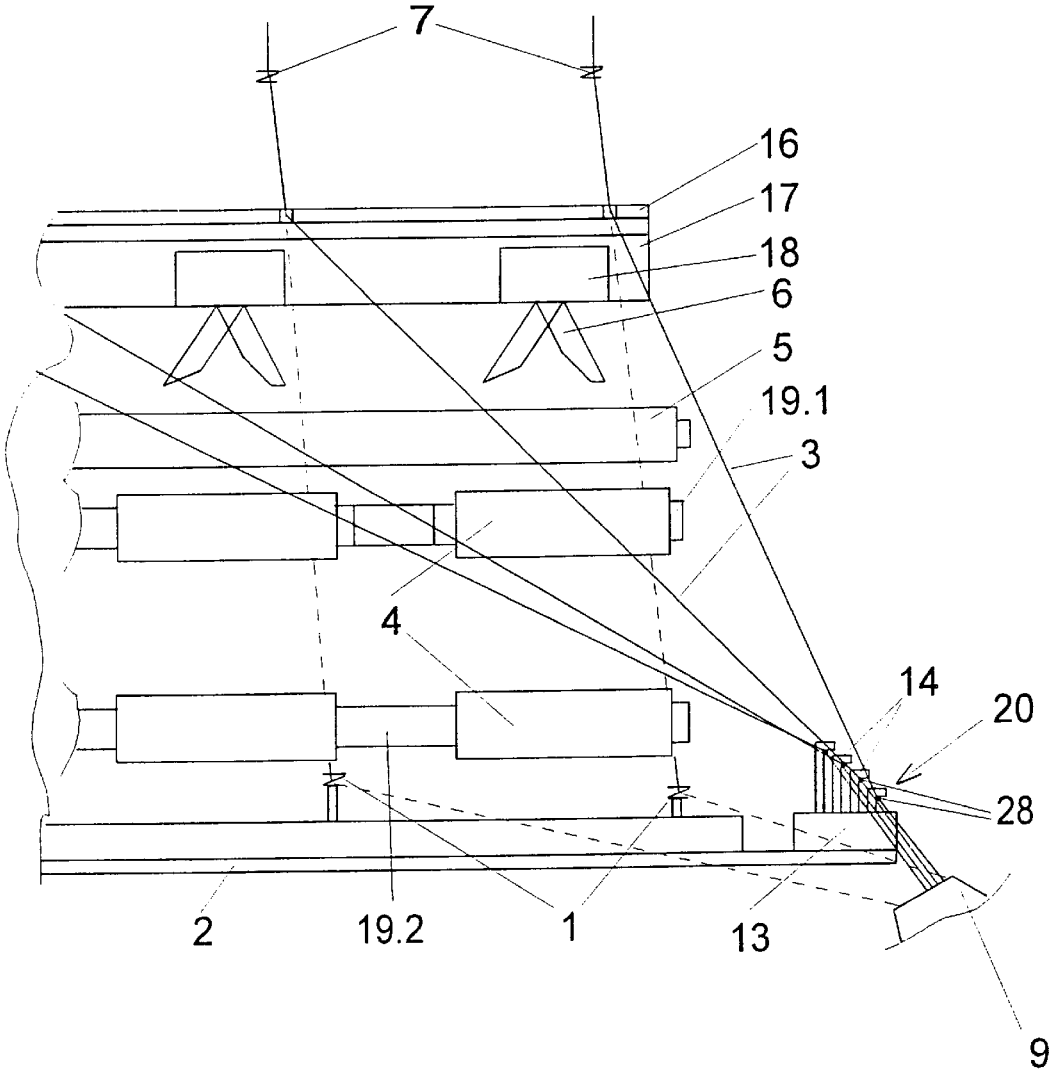
FIG. 1 illustrates a first embodiment of takeup machine with a basic arrangement of the threadup device in accordance with the invention.
Figure 2:
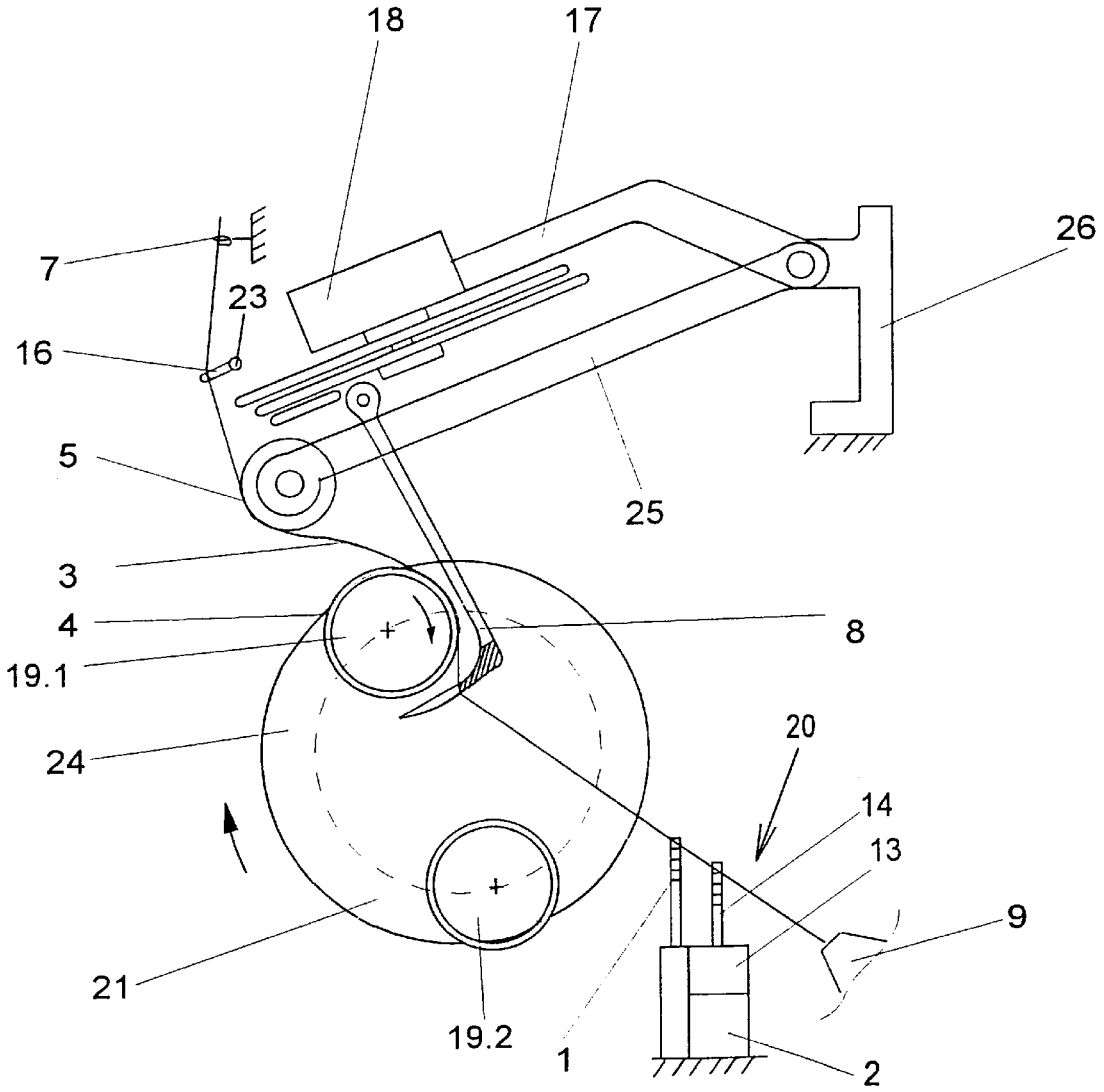
FIG. 2 is a side view of the takeup machine of FIG. 1 with the threadup device of the present invention.

FIGS. 1 and 2 illustrate a basic arrangement of the threadup device in a takeup machine of the present invention. For reasons of simplicity, the Figures show only two yarns 3 that are to be wound.

For each winding position (shown are only two winding positions), the takeup machine is provided with a yarn traversing mechanism 18 with a traversing yarn guide 6, which are attached to a support 17. Upstream of yarn traversing mechanism 18, a yarn lifting device 16 is arranged. The takeup machine has two driven winding spindles 19.1 and 19.2 which are mounted to a turret 24. The winding spindles 19.1 and 19.2 mount several winding tubes 4—shown are only two—which are arranged, one after the other. In the position shown in FIG. 1, the winding spindle 19.1 is in a winding position. A contact roll 5, which is arranged between yarn traversing mechanism 18 and winding spindle 19.1, is not yet in contact with winding tubes 4. In this position, it is now possible to start a first-time yarn threading operation. To this end, a threadup device 20 is used, which is provided with a threadup yarn guide 13 arranged for movement along a guideway 2 and contact yarn guides 1, which are each associated to a winding tube 4. In the position shown in FIG. 1, threadup yarn guide 13 is in a threading position. The threadup yarn guide 13 has a number of yarn carriers 14 corresponding to the number of contact yarn guides, which yarn carriers guide yarns 3 advancing from a yarn suction device 9 each into a guide groove 28. The yarn carriers 14 are arranged on threadup yarn guide 13 in terraced form, so that adjacent yarns are guided relative to one another in different levels. The arrangement of yarn carriers 14 on threadup yarn guide 13 exhibits a slope which ascends in the direction from the threading position to the contacting position. The contact yarn guides 1, which are each arranged stationarily in the contacting position associated to the winding tubes 4, exhibit likewise relative to each other a terraced arrangement that ascends in the same direction. In this instance, the arrangement is selected such that each yarn 3 can be transferred from yarn carrier 14 to contact yarn guide 1, when the threadup yarn guide 13 leaves on guideway 2 its threading position and moves along contact yarn guides 1 arranged in series one after the other.

In FIG. 1, the yarn path in the contacting position is shown in phantom lines.

The yarns 3 advancing from stationary yarn guide 7 to lifting device 16, which guides the yarns 3 outside of the traversing region, are sucked in by yarn suction device 9, which is preferably a suction gun, and inserted by the operating personnel into yarn carriers 14 of threadup yarn guide 13, when same is in the threading position. To start up the actual winding operation, it is necessary to move threadup yarn guide 13 from the threading position in a direction toward the contacting position. In this process, the yarns 3 are distributed over the number of the contact yarn guides 1 which corresponds to the number of packages being wound.

FIG. 2 is a side view of the takeup machine. Via stationary yarn guide 7, the yarn 3 advances, over lifting device 16 mounted for rotation about an axis 23, and contact roll 5, to winding tube 4. The winding tube 4 is mounted on driven winding spindle 19.1. The winding spindles 19.1 and 19.2 are arranged together on rotatable turret 24. The contact roll 5 is supported on a rotatable support arm 25, so that it is able to move in radial direction toward winding tube 4.

The support arms 25 and 17 are mounted to machine frame 26. From winding tube 4, the yarn 3 advances to threadup device 20. In so doing, the yarn 3 is sucked in by suction device 9. After threadup yarn guide 13 with its yarn carriers 14 has transferred by its displacement yarns 3 to the respective contact yarn guides 1, the winding spindle 19 is rotated by means of turret 24 into the yarn path, so that the yarn 3 contacts the surface of winding tube 4. Yarn 3 is then caught by a catching device of winding tube 4. By means of a pivotal sheet metal element 8, which pivots between threadup device 20 and winding spindle 19.1, the yarn is cut, and the actual winding operation can proceed on the package. Since threading by means of the threadup device in accordance with the invention can be made especially simple and fast, it is possible to reduce significantly the time needed for threading and, thus, the amount of waste yarn.

Figure 3:
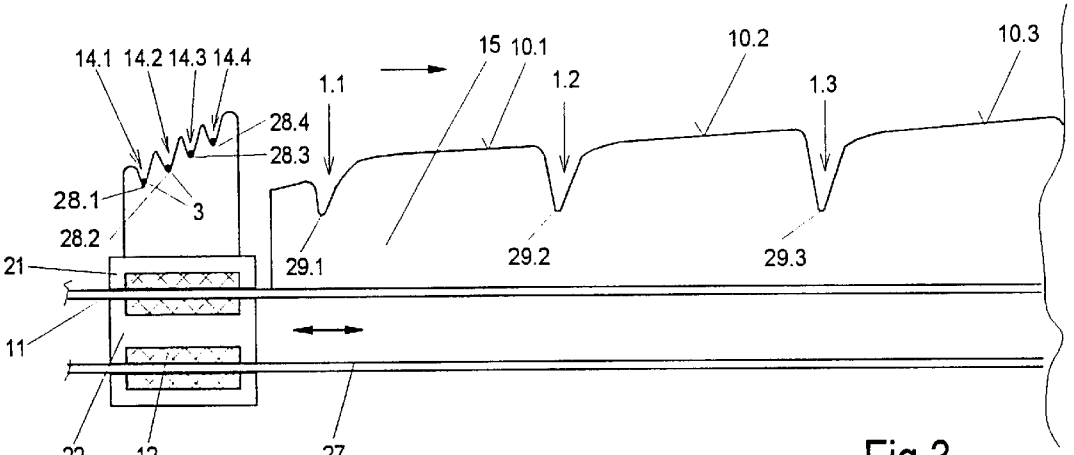
FIGS. 3 and 4 show each a basic arrangement of the threadup yarn guide and the contact yarn guides.
Figure 4:
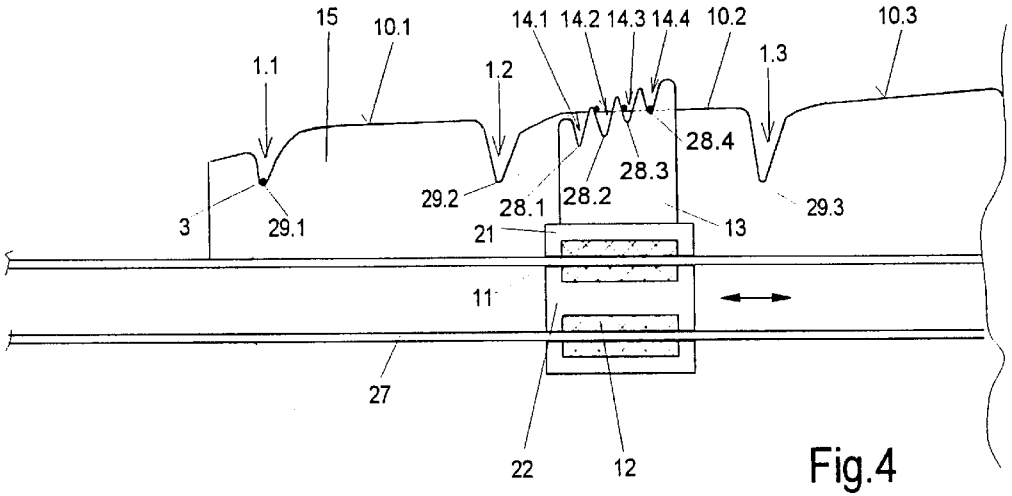

FIGS. 3 and 4 illustrate the basic arrangement of a further embodiment of a threadup device 20. In FIG. 3, the threadup yarn guide 13 is in its threading position. The threadup yarn guide 13 is provided with yarn carriers 14.1, 14.2, 14.3, and 14.4, which are each constructed as a guide groove 28.1, 28.2, 28.3, and 28.4. The guide grooves 28.1–28.4 are all made identical and arranged relative to each other on threadup yarn guide 13 in different heights, so that a terraced arrangement results with a slope ascending in direction of the contacting position. The threadup yarn guide 13 is rigidly connected to a sliding element 21. The sliding element 21 connects to a magnetic guide element 11, both the magnetic guide element 11 and the sliding element 21 being arranged annularly for displacement on the outer surface of a tube 27. The interior of tube 27 accommodates for displacement a magnetic piston 22 with a magnetic counterelement 12. The magnetic counterelement 12 has a polarity opposite to magnetic guide element 11, the guide element 11 resting against the outer surface of tube 27 and the counterelement 12 against the inner surface thereof. Thus, an engagement by magnetic force is produced between piston 22 and sliding element 21. As piston 22 is displaced with magnetic counterelement 12 inside tube 27, which can occur, for example, without piston rod by a pneumatic arrangement, sliding element 21 surrounding the outside surface of tube 27 can be axially displaced as a result of the engagement by magnetic force. Important is that opposite magnets, i.e., the magnet in the interior and the magnet arranged on the outside circumference of the tube, have opposite polarities.

A panel in the form of a strip 15 is mounted to extend parallel to the tube 27, and the strip mounts contact yarn guides 1.1, 1.2, and 1.3. The yarn guides 1.1–1.3 are formed in the strip by catching notches 29.1, 29.2, and 29.3, which are interconnected by guide edge sections 10.1, 10.2, and 10.3. In this arrangement, the guide edge 10 of strip 15 as a whole is oriented such that it forms a slope in the direction from contact yarn guide 1.1 to contact yarn guide 1.3 and beyond. In the position shown in FIG. 3, threadup yarn guide 13 is in its threading position. In this position, the yarns 3 are guided by means of suction device 9 as shown in FIGS. 1 and 2, and inserted by an operator into respective yarn carriers 14.1–14.4. Once the takeup machine is ready for catching yarns 3 on winding tubes 4 associated to respective winding positions, threadup yarn guide 13 is displaced by means of compressed-air actuated piston 22 in direction of the arrow. After the threadup yarn guide passes contact yarn guide 1.1, yarn 3 is guided by guide edge 10.1 in groove 28.1 such that it slides out of groove 28.1 as threadup yarn guide 13 continues its movement. Once yarn 3 has lost its guiding contact with threadup yarn guide 13, it drops automatically into catching notch 29.1 of contact yarn guide 1.1. As shown in FIG. 4, yarn 3 is in the process of being guided by edge 10.2 out of groove 28.2 of threadup yarn guide 13. As threadup yarn guide 13 continues to move on, yarn 3 is thus bound to drop into catching notch 29.2 of contact yarn guide 1.2. Since during the displacement of threadup yarn guide 13 yarn suction device 9 remains in the threading position, the yarns 3, once having lost their guiding contact with threadup yarn guide 13, are urged to move over guide edge 10 into their respective catching notches. The threadup yarn guide 13 is displaced until all yarns are transferred into corresponding contact yarn guides 1. Subsequently, the yarns are brought into contact with the tubes, as has been described above with reference to FIG. 2. In this instance, the sheet metal element 8 causes the yarns to be held against the surface of winding tubes 4 and to be thus caught on the winding tube. Once the yarns are caught on the winding tube, they are cut by a blade integrated in sheet metal element 8. The winding operation starts. During this period of time, threadup yarn guide 13 is displaced back to its threading position.

Figure 5:
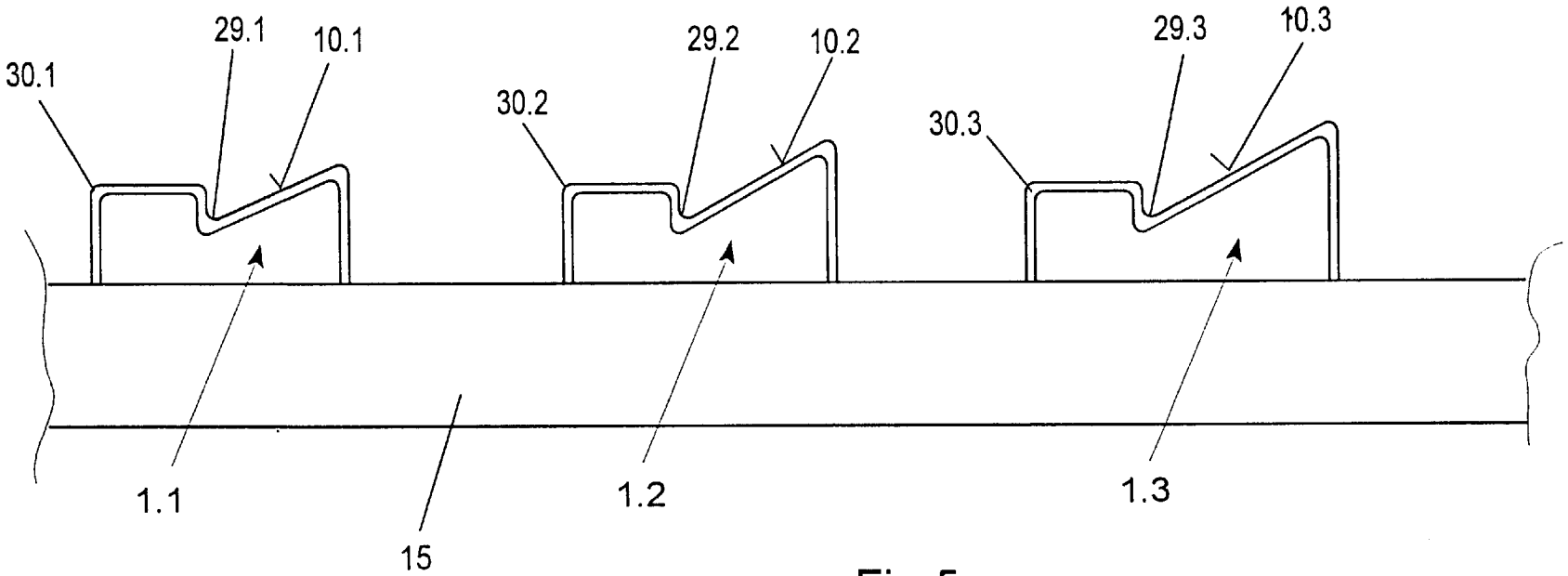
FIG. 5 illustrates an embodiment of the contact yarn guides.

FIG. 5 is a cutout view of a further embodiment of contact yarn guides in a threadup device. The contact yarn guides 1.1, 1.2, and 1.3 are mounted one after the other in spaced relationship to a strip 15. Each contact yarn guide is formed from a piece of wire 30, the ends of wire piece 30 being connected to strip 15. The wire piece is bent in U-shape, thereby forming in the partial length of the wire that is aligned with the strip in axial direction a catching notch 29 and a guide edge 10. The partial lengths forming guide edges 10.1, 10.2, and 10.3 of contact yarn guides 1.1, 1.2, and 1.3 extend each, when inserting the yarns into notches 29.1, 29.2, and 29.3 and when viewed in the direction of movement of the threadup yarn guide (not shown), behind catching notches 29. This ensures that a yarn having been lifted out of the threadup yarn guide, advances automatically along inclined guide edge 10 into the corresponding catching notch 29.

Figure 6:
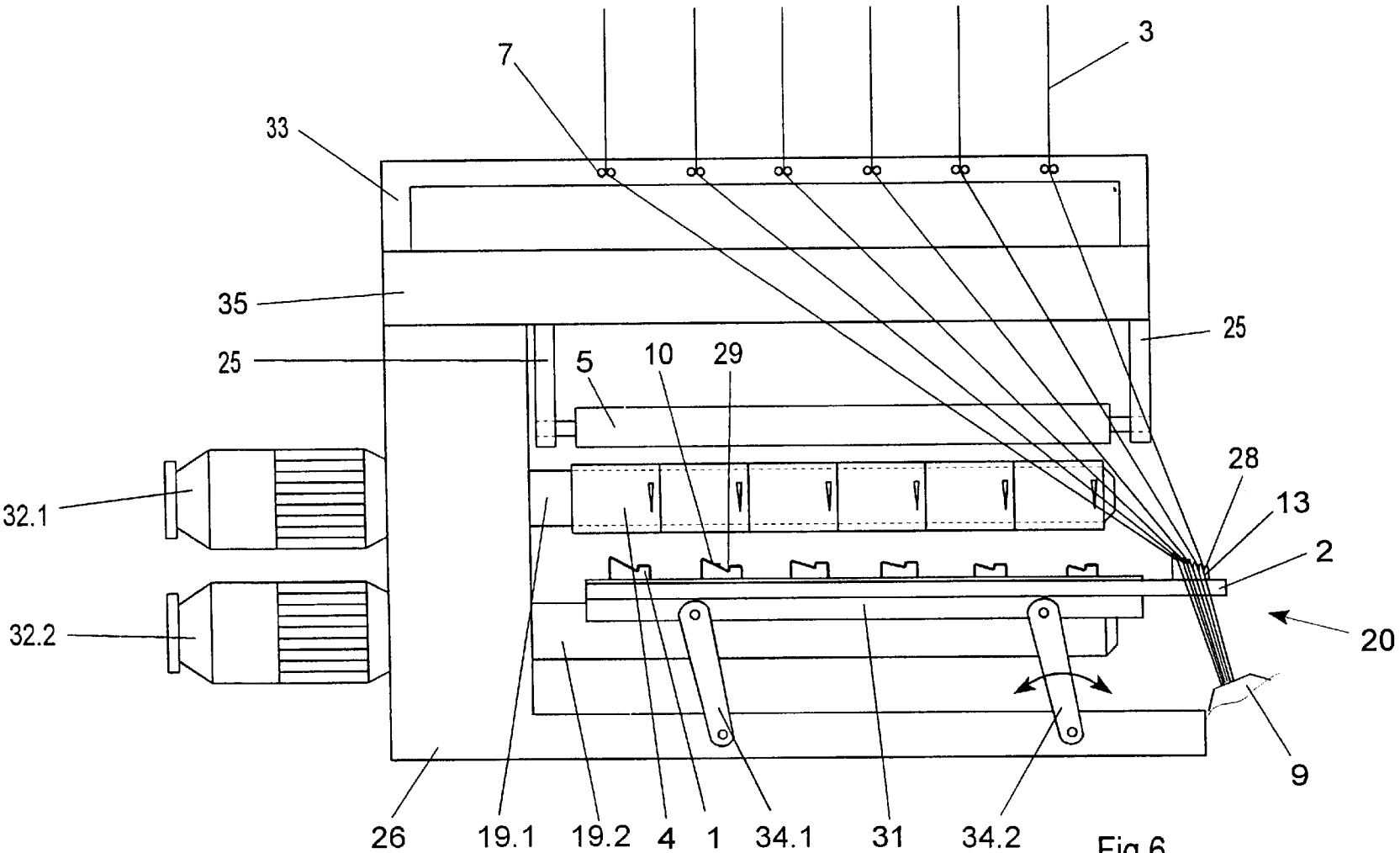
FIGS. 6 and 7 show further embodiments of the takeup machine in accordance with the invention.
Figure 7:
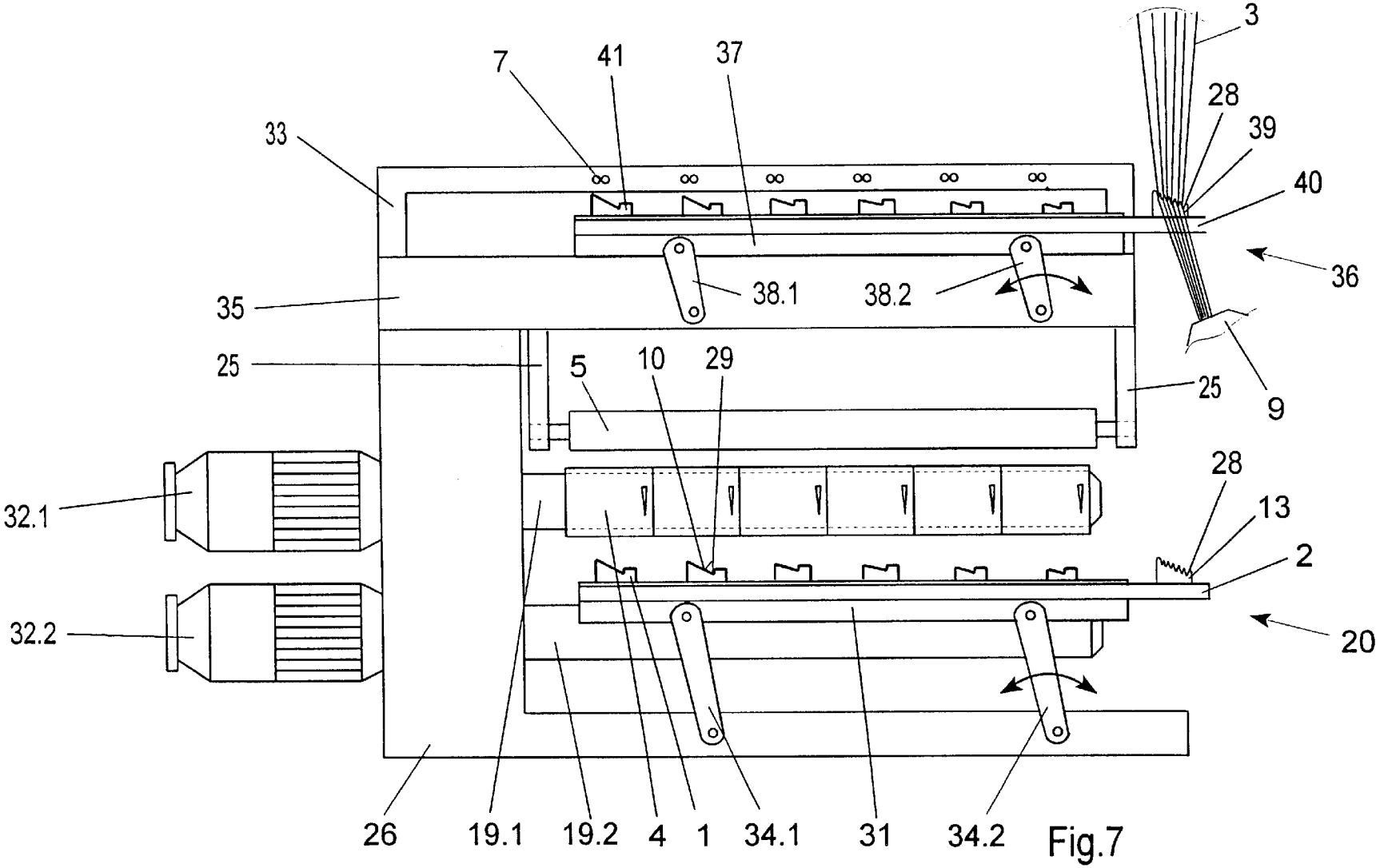

FIGS. 6 and 7 illustrate two further embodiments of the takeup machine in accordance with the invention. In these embodiments, structural members having like functions are indicated by the same numerals as in the previously described embodiments.

The basic layout of the takeup machines of FIGS. 6 and 7 is essentially identical with the layout of the takeup machine of FIG. 1. For a better illustration, the yarn traversing mechanism as well as auxiliary devices for catching the yarn on the winding tubes are not shown. The takeup machine has a frame 26, which mounts winding spindles 19.1 and 19.2 in a rotatable support. The winding spindles 19.1 and 19.2 are driven by spindle motors 32.1 and 32.2. Arranged parallel to the winding spindles is a contact roll 5, which is arranged, via a support arm 25, on a traversing beam 35. The traversing beam 35 mounts the yarn traversing mechanisms not shown. Above traversing beam 35, a holder 33 is arranged, which mounts a total of six stationary yarn guides 7 that are each associated to a winding position. All six winding tubes 4 are arranged, one after the other, on the winding spindle 19.1 being in its operating position.

The takeup machine of FIG. 6 has a threadup device 20 arranged on a support 31. The contact yarn guides 1 of the threadup device are mounted directly to support 31. They may be made, for example, of wire pieces, as shown in FIG. 5, or of sheet metal. Each contact yarn guide has a catching notch 29 and a guide edge 10. In an adjacent plane parallel to the contact yarn guides 1, support 31 mounts a guideway 2. In this guideway 2, a threadup yarn guide 13 is displaced. The relation between guide grooves 28 arranged in threadup yarn guide 13 and guide edges 10 of contact yarn guides 1 corresponds to that of the embodiment described with reference to FIGS. 3 and 4.

The support 31 is connected to machine frame 26 by means of rocking arms 34.1 and 34.2. One of rocking arms 34.1 or 34.2 is coupled with a drive, so that support 31 can be moved in a plane parallel to the long side of the machine from an idle position to an operation position. In FIG. 6, the threadup device is shown in its operating position. In its idle position, the support would be pivoted in direction of machine frame 26.

In the operating position of the threadup device as shown in FIG. 6, the yarns are in process of being inserted by yarn suction device 9 into guides grooves 28 of threadup yarn guide 13. The yarns 3 advance via stationary yarn guides 7 into the takeup machine to guide grooves 28 of threadup yarn guides 13 and to suction device 9. To distribute the yarns 3 to the individual winding positions, threadup yarn guide 13 moves in direction toward the supported end of winding spindle 19.1. The yarn is distributed in the manner as has been previously described with reference to FIGS. 3 and 4. Once the yarns 3 are distributed to the individual contact yarn guides 1, auxiliary devices (not shown) engage, which make it possible to catch the yarn on winding tube 4 and bring same into the traversing mechanism.

The support 31 may however be also arranged or moved in such a manner that a movement can be performed transversely to the long side of the takeup machine. As a result of such a movement it is possible to vary, for example, the looping of the yarn on the winding tube. Thus, auxiliary devices, which engage between the winding tube and the threadup device, can be used exclusively for cutting the yarns.

FIG. 7 illustrates a further embodiment of the takeup machine, in which a second threadup device 36 is arranged on a movable support 37 on traversing beam 35. In this embodiment, the threadup device 36 is mounted to support 37. The support 37 is mounted to traversing beam 35 by means of rocking arms 38. As a result, the threadup device 36 can be pivoted likewise from an idle position to an operating position.

The threadup device 36 is constructed in the same manner a threadup device 20. With respect thereto, reference may be made to the description of FIG. 6. In FIG. 7, threadup device 36 is shown in its threading position. The yarns 3 advance via a suction device 9 directly from the spinning line to the guide grooves of threadup yarn guide 39. To insert yarns 3 into stationary yarn guides 7, the threadup yarn guide 39 is moved along a guideway 40 for distributing the yarns to contact yarn guides 41. Once the yarns are guided in contact yarn guides 41, they are inserted into stationary yarn guides 7.

However, the threadup device 36 of FIG. 7 may also be realized such that the yarns 3 are inserted into the corresponding stationary yarn guides 7 directly by threadup yarn guide 39. In this embodiment, the stationary yarn guides would be constructed in accordance with the contact yarn guides 41.

The threadup device of the present invention can be used likewise in other places of a spin line or a textile machine, for purposes of distributing yarns from a collective position to a plurality of operating positions. To this end, the operating positions may be arranged in one plane or in different planes. The guidance of the threadup yarn guide may cover a path that is made straight-line, curved, or offset.

NOMENCLATURE

| | |
|---|---|
| 1 | Contact yarn guide |
| 2 | Guideway |
| 3 | Yarn |
| 4 | Winding tubes |
| 5 | Contact roll |
| 6 | Traversing yarn guide |
| 7 | Stationary yarn guide, apex yarn guide |
| 8 | Pivotal sheet metal element |
| 9 | Yarn suction device |
| 10 | Guide edge |
| 11 | Magnetic guide element |
| 12 | Magnetic counterelements |
| 13 | Threadup yarn guide |
| 14 | Yarn carrier |
| 15 | Strip |
| 16 | Lifting device |
| 17 | Support |
| 18 | Yarn traversing mechanism |
| 19 | Winding spindle |
| 20 | Threadup device |
| 21 | Sliding element |
| 22 | Piston |
| 23 | Axis of rotation |

-continued

| NOMENCLATURE | |
|---|---|
| 24 | Turret |
| 25 | Support arm |
| 26 | Machine frame |
| 27 | Tube |
| 28 | Guide groove |
| 29 | Catching notches |
| 30 | Wire piece |
| 31 | Support |
| 32 | Spindle motor |
| 33 | Holder |
| 34 | Rocking arm |
| 35 | Traversing beam |
| 36 | Threadup device |
| 37 | Support |
| 38 | Rocking arm |
| 39 | Threadup yarn guide |
| 40 | Guideway |
| 41 | Contact yarn guide |

I claim:

1. A winding apparatus for winding a plurality of advancing yarns into respective yarn packages, comprising a winding spindle of a length sufficient to coaxially receive a plurality of winding tubes thereon, with the spindle defining an axis and a free end, a threadup device for distributing the advancing yarns into contact with respective ones of the winding tubes so as to permit the threadup of the yarns onto the winding tubes, said threadup device comprising (a) a stationary contact yarn guide positioned adjacent each of the winding tubes, with the contact yarn guides being aligned along a direction generally parallel to the axis of the winding spindle, and (b) a threadup yarn guide configured to engage each of the advancing yarns and being mounted for movement along a path of travel which is generally parallel to the axis of the winding spindle and which extends from a threading position located adjacent the free end of the winding spindle and along the contact yarn guides, and with the threadup yarn guide and the contact yarn guides being configured to distribute the advancing yarns from the threadup yarn guide one after the other to respective contact yarn guides as the threadup yarn guide moves from the threading position along the path of travel.

2. The winding apparatus as defined in claim 1 wherein the threadup yarn guide comprises a plurality of successively arranged yarn carriers, with the carriers being arranged in a terraced configuration which ascends in the direction from the threading position toward the contact yarn guides.

3. The winding apparatus as defined in claim 2 wherein the carriers are each in the form of a guide groove arranged transversely to the direction of movement of the threadup yarn guide along the path of travel.

4. The winding apparatus as defined in claim 2 wherein the contact yarn guides are arranged in a terraced configuration which ascends in the direction from the threadup position toward the contact yarn guides, and so that each carrier is positioned to cooperate with a predetermined contact yarn guide as the threadup yarn guide moves from the threading position along the path of travel.

5. The winding apparatus as defined in claim 2 wherein the contact yarn guides comprise notches formed in a guide edge of a panel which extends along the path of travel, with the guide edge of the panel ascending in a direction from the threadup position toward the contact yarn guides, so that the yarns carried by the carriers of the threadup yarn guide are guided out of the carriers by the guide edge and into respective notches as the threadup yarn guide moves from the threadup position along the path of travel.

6. The winding apparatus as defined in claim 2 wherein the contact yarn guides comprise notches formed in respective guide edge segments which extend along the path of travel, with the guide edge segments ascending in a direction from the threadup position along the path of travel, so that the yarns carried by the carriers of the threadup yarn guide are guided out of the carriers by the guide edge segments and into respective notches as the threadup yarn guide moves along the path of travel.

7. The winding apparatus as defined in claim 1 wherein the path of travel of the threadup yarn guide is defined by a guideway along which the threadup yarn guide is mounted for movement.

8. The winding apparatus as defined in claim 7 wherein the threadup yarn guide comprises a sliding element mounted for sliding movement along the guideway, and further comprises mechanical, pneumatic, or electric means for selectively moving the sliding element along the guideway.

9. The winding apparatus as defined in claim 8 wherein the guideway includes a tube, and the sliding element comprises a magnetic guide member slideably mounted on the outside of the tube, and the means for selectively moving the sliding element along the tube includes a magnetic piston slideably mounted in the interior of the tube and which is configured to magnetically engage the magnetic guide member, and means to reciprocate the piston and thus the magnetic guide element along the tube.

10. The winding apparatus as defined in claim 1 wherein the threadup device is mounted to a moveable support so as to be moveable between an idle position and an operating position.

11. The winding apparatus as defined in claim 10 wherein the threadup device is mounted to the moveable support so as to be moveable in a direction generally parallel to the axis of the winding spindle between the idle position and the operating position.

12. The winding apparatus as defined in claim 1 further comprising a stationary yarn guide associated with each of the winding tubes on the winding spindle at a location upstream of the associated tube, and a second threadup device for distributing the yarns to respective ones of the stationary yarn guides.

13. The winding apparatus as defined in claim 12 wherein the second threadup device includes a second threadup yarn guide configured to engage each of the advancing yarns and being mounted for movement along a second path of travel which is generally parallel to the axis of the winding spindle and which extends from a second threading position located adjacent the free end of the winding spindle and along the stationary yarn guides, and with the second threadup yarn guide and the stationary yarn guides being configured to distribute the advancing yarns from the second threadup yarn guide to directly respective stationary yarn guides one after the other as the second threadup yarn guide moves from the second threading position along the second path of travel.

14. The winding apparatus as defined in claim 13 further comprising a yarn traversing device positioned between each of the stationary yarn guides and the associated winding tube for forming a cross wound package on each of the winding tubes.

15. The winding apparatus as defined in claim 12 wherein the second threadup device includes (a) a second stationary contact yarn guide positioned to be associated with each of the winding tubes, with the second stationary contact yarn guides being aligned along a direction generally parallel to the axis of the winding spindle, and (b) a second threadup yarn guide configured to engage each of the advancing yarns and being mounted for movement along a second path of travel which is generally parallel to the axis of the winding spindle and which extends from a second threading position located adjacent the free end of the winding spindle and along the second stationary contact yarn guides, and with the second threadup yarn guide and the second stationary contact yarn guides being configured to distribute the advancing yarns from the second threadup yarn guide to respective second stationary contact yarn guides one after the other as the second threadup yarn guide moves from the second threading position along the second path of travel, and with the second stationary contact yarn guides being positioned to then guide the advancing yarns into respective ones of the stationary yarn guides.

16. The winding apparatus as defined in claim 15 wherein the first mentioned threadup device is mounted to a first moveable support so as to be moveable in a direction generally parallel to the axis of the winding spindle between an idle position and an operating position, and wherein the second threadup device is mounted on a second moveable support so as to be moveable in a direction generally parallel to the axis of the winding spindle between an idle position and an operating position.

* * * * *